United States Patent [19]

Emain

[11] 4,070,798

[45] Jan. 31, 1978

[54] POLISHING WHEELS

[76] Inventor: Jean Emain, Beau Site. Serger, 39200 Saint-Claude, France

[21] Appl. No.: 715,284

[22] Filed: Aug. 18, 1976

[30] Foreign Application Priority Data

Aug. 26, 1975 France ..... 75 20310

[51] Int. Cl.[2] ..... B24D 9/06

[52] U.S. Cl. ..... 51/361; 51/368; 51/384

[58] Field of Search ..... 51/330, 331, 352–354, 51/357–361, 367–369, 384, 388, 389, 390

[56] References Cited

U.S. PATENT DOCUMENTS

| | | | |
|---|---|---|---|
| 352,988 | 11/1886 | Bridgman | 51/390 X |
| 564,587 | 7/1896 | Black | 51/335 |
| 1,284,786 | 11/1918 | Safka | 51/353 |
| 2,102,745 | 12/1937 | Read | 51/368 X |
| 2,465,225 | 3/1949 | Haren | 51/357 X |
| 2,751,727 | 6/1956 | McAfee | 51/390 |
| 2,767,526 | 10/1956 | Moran | 51/335 |

FOREIGN PATENT DOCUMENTS

| | | | |
|---|---|---|---|
| 870,588 | 6/1961 | United Kingdom | 51/361 |

*Primary Examiner*—Al Lawrence Smith
*Assistant Examiner*—Nicholas P. Godici
*Attorney, Agent, or Firm*—Bucknam and Archer

[57] ABSTRACT

A polishing wheel is provided which comprises a circular rotatable body, a plurality of spaced apart rigid support members provided on the periphery of the rotatable body, a layer of resilient material provided on the periphery of each said support member and a strip covered with abrasive material supported on each layer of resilient material. The abrasive strip is secured on the support member by means for regulating the tension of said strip. A plurality of cylindrical members may be provided for retaining the ends of the strips between said cylindrical members and the inner side of the support member, each said cylindrical member being mounted eccentrically in a bore in the circular rotatable body and being locked by a screw. Alternatively, the abrasive strip may be continuous and form a sleeve engaged on the support member and on a cylindrical member mounted eccentrically on the body.

5 Claims, 17 Drawing Figures

POLISHING WHEELS

The present invention relates to an improvement to polishing wheels.

The polishing of certain articles and in particular the polishing of a briar pipe has not progressed for many years and this is despite the appearance on the market of polishing wheels which have been the subject of experimentation.

At present, the polishing of pipes is carried out on a wooden mandrel screwed to a lathe nose, said mandrel being provided on its front side with a felt support, resting on which is a cloth covered with abrasive material, which is supported on the felt part assuming the shape of a mushroom. The abrasive cloth is retained by flanges previously cut in the latter and secured by means of a nut behind the mandrel.

Numerous polishing wheels are also known, such as rubber wheels having an expansible rim on which a ring of abrasive cloth is retained by a mechanical or centrifugal method.

Nevertheless, this type of wheel comprises a support which is too hard and it is too abrasive even with a fine-grained finishing cloth. Due to this, this type of wheel does not facilitate precise work and has the serious drawback of deforming the pipe by forming facets on the latter.

A wheel is also known in which strips of abrasive cloth are fixed at one of their ends to the hub of the wheel, whereas the other end is free, such that each strip of abrasive cloth lashes the workpiece to be polished whilst bearing on a semi-flexible brush or any other deformable support member.

However, a device of this type comprises a support which is too flexible and is therefore insufficiently abrasive. The result of this is that the polishing time is long and varies considerably depending on whether the abrasive lining is new or used, which necessitates frequent changing of the abrasive strips owing to this lack of abrasive quality.

Furthermore, the result obtained is not satisfactory, owing to the fact that the edges become rounded on the polished object, in particular for a pipe, on the top of the bowl and the body of the bowl, on the stem and on the tip of the stem adjacent the tube. Similarly, the connection between the stem and bowl of the pipe is long and produces a risk of deformation.

Finally, the noise caused by the wheel during operation is deafening and the ends of the lashing cloths become worn rapidly and break on bending.

It is also known to use a polishing tool which is constituted by a certain number of independent polishing members detachably mounted on a rotary support disc, said grinding members being constituted by support members on which sleeves comprising an abrasive lining are engaged.

Provided in the central part of the disc is a member for locking the sleeves on the support members.

Nevertheless, this polishing device does not comprise any means for regulating the tension of the sleeve.

Therefore, none of the known methods facilitates easy, rapid and high quality work, without the use of very skilled staff, which is difficult and expensive to train.

On the other hand, the improved polishing wheel according to the invention provides a simple solution to the problem of polishing objects such as pipes. This polishing operation may be carried out by unskilled staff and facilitates an increase in the quality of the polished product as well as the quantity of objects produced.

Furthermore, the polishing wheel according to the invention makes it readily possible to store a certain quantity of abrasive strip on the wheel and to bring it into the position for use on the support, whereas with the method currently used, replacement of the abrasive strip takes a long time and is tedious.

According to the invention, an improved polishing wheel is used comprising a circular rotary body which is provided on its periphery with rigid support members separated by gaps, each of said support members being provided on its periphery with a layer of resilient material, resting on which is a strip covered with abrasive material, characterised in that the abrasive strip is secured at the upstream and downstream end to the support member by means for adjusting the tension of said strip acting at the upstream end whereas the strip is retained at the downstream end.

This arrangement makes it possible to achieve adjustable tension of the abrasive strip which may be slack and floating or stretched over its resilient support.

This results in a uniform abrasive quality and uniformity of production as the abrasive strip wears.

In view of the fact that the pressure on the workpiece during polishing should be less when the abrasive strip is new and greater when its abrasive qualities decrease, that the workpiece to be polished deforms more easily when the abrasive strip is new and less when its abrasive qualities are reduced and that it takes less time to polish a workpiece with a new cloth and longer when its abrasive qualities are reduced, by adjusting and controlling the tension of the abrasive strip, the device according to the invention makes it possible to obtain an abrasive quality of the latter which is substantially constant throughout its productive life.

At the beginning of its work, since the abrasive strip is new and therefore highly abrasive, it may therefore be mounted so that it is only slightly taut or floating, if necessary.

Polishing takes place quickly without causing either the production of facets or holes.

During the work, owing to wear, the strip becomes progressively less abrasive, which requires certain tension of the latter on the deformable support.

Polishing therefore takes place just as quickly, owing to the fact that the reduction in quality of the abrasive strip is compensated for by greater pressure of the workpiece to be polished on the deformable support and without causing either facets nor holes.

The device according to the invention therefore makes it possible to polish a pipe with a single fine-grained finishing cloth, which nevertheless has sufficient abrasive qualities, whereas with the known methods, it is necessary to use two or three increasingly finer cloths. This results in a gain in production.

Similarly, an appreciable saving is made on the consumption of abrasive cloth.

Further features and advantages of the invention will be better understood on reading the ensuing description of several embodiments referring to the accompanying drawings in which.

Figure 2:
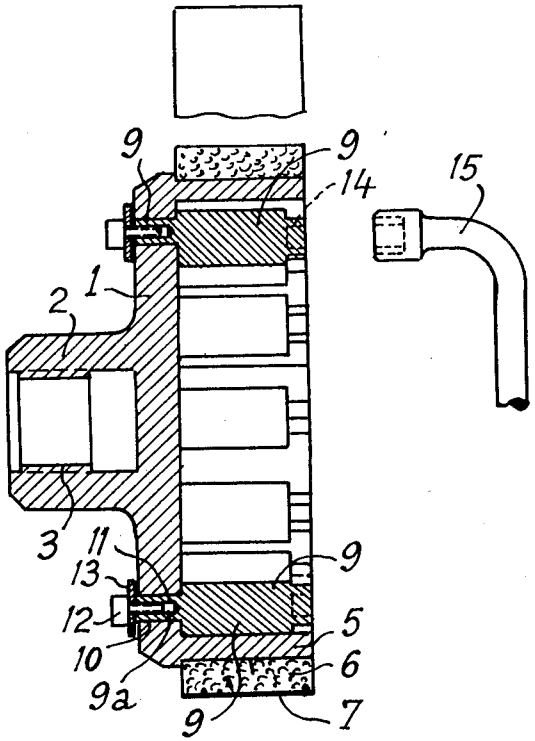
FIG. 2 is a sectional view on line II—II of FIG. 1.
Figure 1:
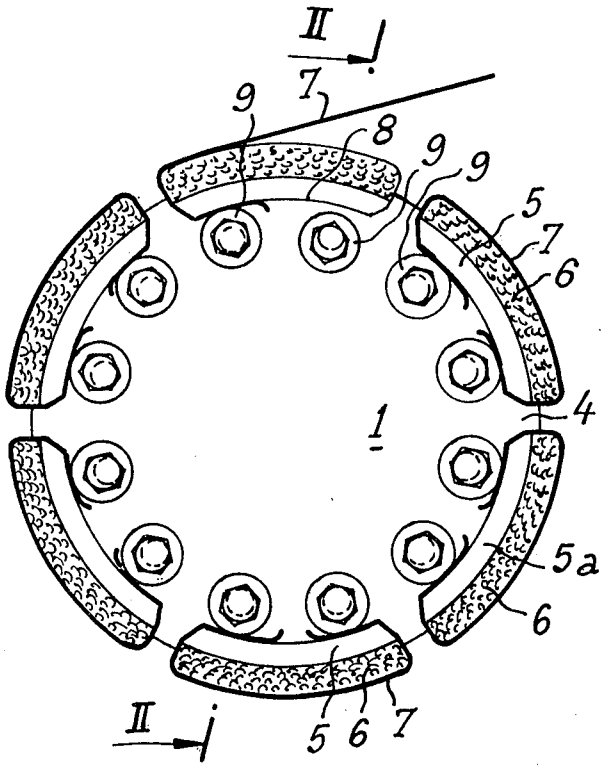
FIG. 1 is a front elevational view of one enbodiment of a polishing wheel according to the invention.

FIGS. 1 and 2 illustrate one embodiment of a polishing wheel according to the invention, consisting of a circular body 1 comprising a hub 2 on one side, in which hub a tapped hole 3 is provided, intended to receive a rotary shaft (not shown in the drawings) for driving the body 1.

On the other side, the body 1 is in the shape of a bell, whose side wall comprises slots 4 defining support members 5, 5*a*, aranged on the periphery of the body 1 and which are provided with a layer 6 of resilient material (in particular elastomeric material) stuck to the support and having a shore hardness of 12 to 25. Resting on the layer 6 of resilient material is a strip 7 covered with abrasive material, secured at the downstream and upstream ends by an eccentric member.

The abrasive strip 7 is thus retained at each of its ends between the inner side 8 of the support members 5, 5*a* and a cylindrical member 9 extended by an eccentric lug 9*a* engaged in a bore 10 in the body 1, said lug 9*a* comprising a tapped hole 11, engaging in which is a screw 12 provided with a resilient washer 13.

on the opposite side to where it is secured to the body 1, the cylinder 9 comprises a hexagonal nut 14 accessible from the open side of the body 1 and making it possible by means of a spanner 15 to pivot the cylindrical member 9 and tighten the latter against the inner side 8 of the support member 5, 5*a*, thus retaining the abrasive strip 7. This arrangement makes it possible to regulate the tension of the strip 7 on the resilient layer 6 by acting on the cylindrical members 9.

Figure 3:
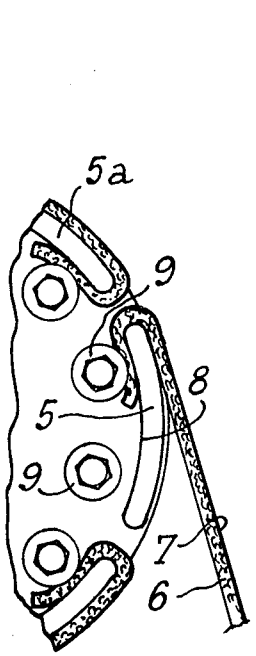
FIG. 3 is a detailed view showing another embodiment of the abrasive cloth and deformable support.

FIG. 3 shows a variation in which the abrasive strip 7 is stuck to the layer 6 of resilient material. In this case, the stratified layer thus formed is retained between the inner side of the support member 5 and the cylindrical member 9.

Figure 5:
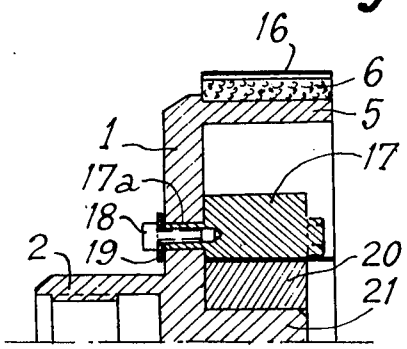
FIG. 5 is a sectional view on line V—V of FIG. 4.
Figure 4:
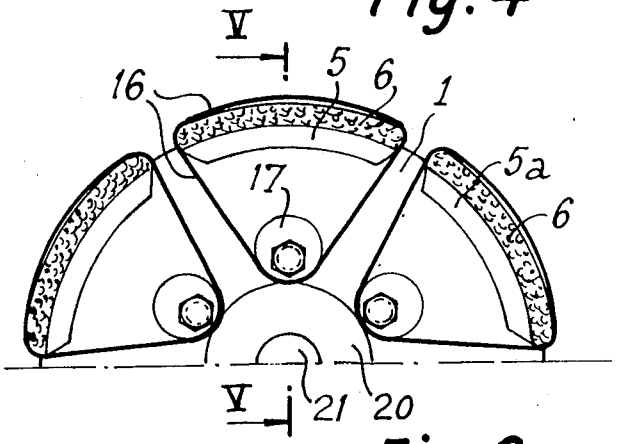
FIG. 4 is a half view of a polishing wheel provided with rings of abrasive cloth, in a slack condition.
Figure 6:
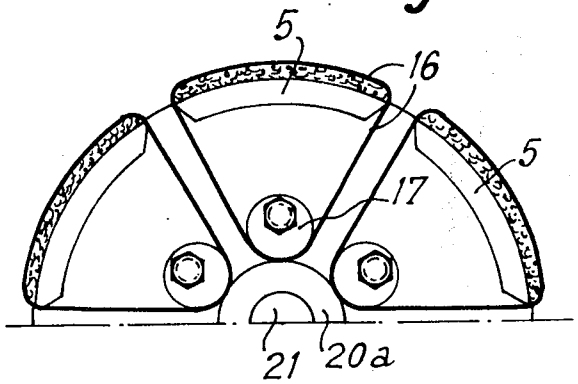
FIG. 6 is a half view of a wheel identical to that of FIG. 4, in a stretched condition.

FIGS. 4, 5 and 6 show a variation of the invention in which a continuous abrasive strip 16 is used, in order to form a sleeve which is engaged on the support member 5 above the layer of resilient material 6 and on a cylindrical member 17 comprising an eccentric lug 17*a* engaged in a bore in the body 1 and secured by means of a screw 18 and washer 19, said cylindrical member 17 being able to come into contact with a removable ring 20 arranged on a central shaft 21 integral with the body 1.

This arrangement makes it possible to modify the tension of the endless strip 16 by pre-adjustment, by replacing the ring 20 (FIG. 4) by a ring 20*a* (FIG. 6) of smaller diameter.

Figure 7:
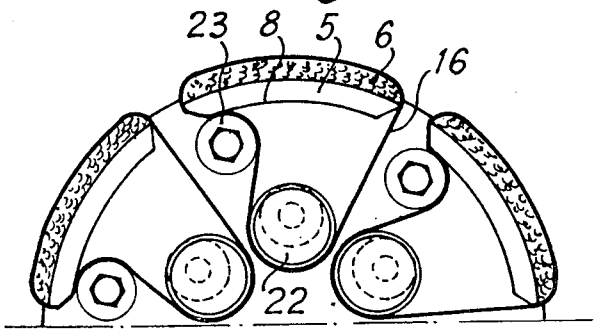
FIG. 7 is a half view of a variation of FIG. 4.

FIG. 7 shows a variation of the preceding embodiment, in which the endless abrasive strip 16 is engaged on the support 5 and on an eccentric cylindrical member 22 mounted on the body 1 and possibly retained by resilient means constituted by a spring.

Furthermore, located at one of the ends of the support 5 is an eccentric cylindrical member 23 able to lock the strip 16 at its downstream end against the inner side 8 of the support 5.

The eccentric cylindrical member 22 makes it possible to regulate the tension of the endless strip 16 by appropriate rotation.

Figure 9:
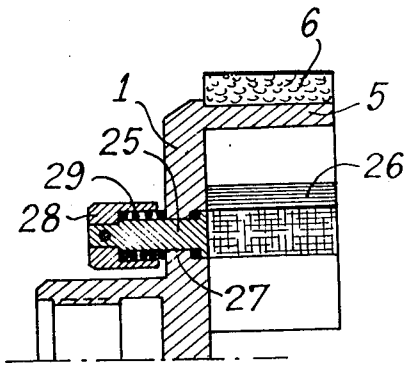
FIG. 9 is a half sectional view on line IX—IX of FIG. 8.
Figure 8:
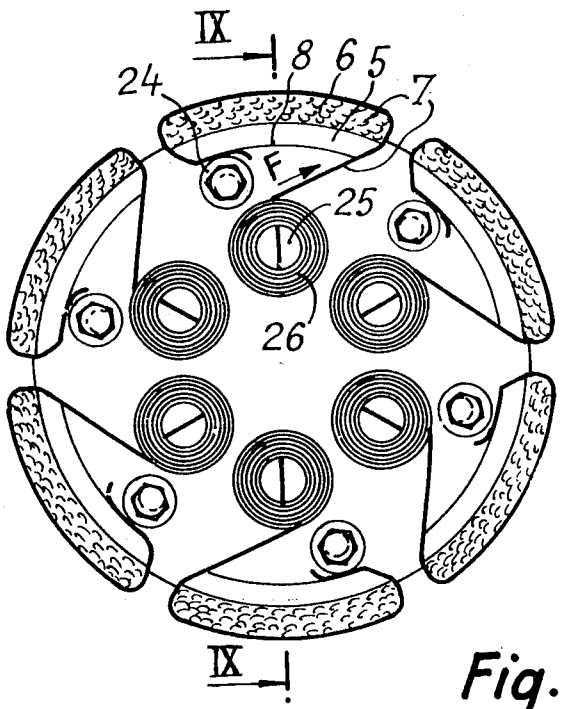
FIG. 8 is a front view of another embodiment of a polishing wheel comprising several rolls of abrasive strip.

FIGS. 8 and 9 show another embodiment of the polishing wheel, in which the abrasive strip 7 is secured downstream at one of its ends between the inner side 8 of the support 5 and an eccentric cylindrical member 24. The other end of the strip 7 is fixed to a shaft 25 on which said new strip is wound to form a reserve 26 which is unwound in the direction of arrow F as it wears.

The shaft 25 is mounted to rotate in a bore 27 of the body 1 and it is provided at the rear with a cap 28, bearing against which is a spring 29 which is in turn supported against the body 1.

The tension of the strip is obtained by rotating the shaft 25, which is retarded by friction.

Figure 11:
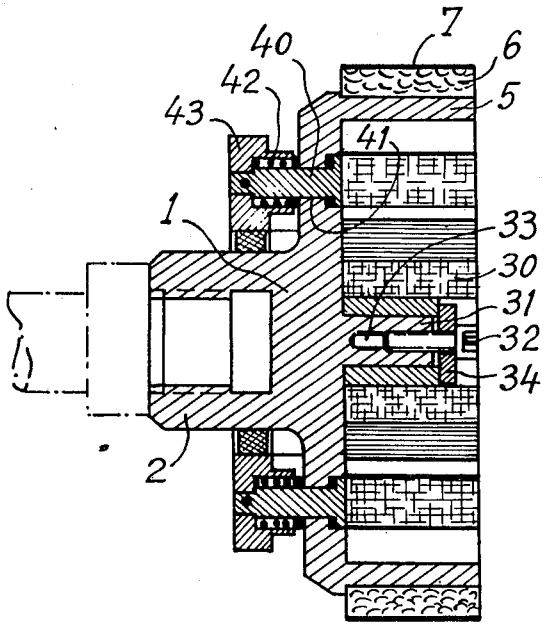
FIG. 11 is a sectional view on line XI—XI of FIG. 10.
Figure 10:
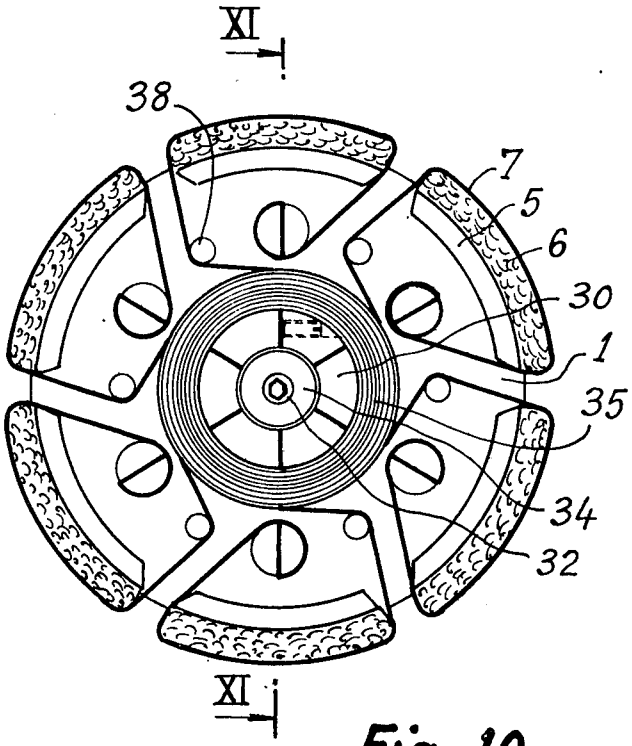
FIG. 10 is a front view of a polishing wheel comprising a central supply drum.
Figure 12:
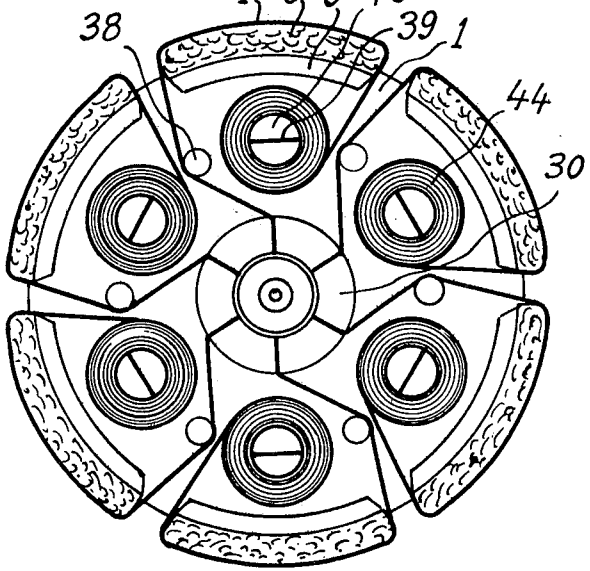
FIG. 12 is the same front view of the wheel as in FIG. 10, when the supply drum is empty.
Figure 13:
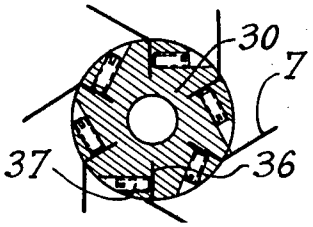
FIG. 13 is a sectional view of the supply drum.

FIGS. 10, 11 and 12 show another embodiment of a polishing whel with a central supply.

The abrasive strips 7 are wound and stored on a magazine drum 30 mounted to rotate on a central boss 31 and able to be locked on the wheel during polishing by means of a screw 32 engaged in a tapped hole 33 and by means of a washer 34.

The new abrasive strips 7 wound on the drum 30 form a load 35 and they are secured by one of their ends which is engaged in slots 36 provided on the drum 30 and retained by means of a screw 37.

Each abrasive strip 7 is guided on a spindle 38 force-fitted in the body 1 of the wheel and it then passes over the resilient layer 6 of the support member 5.

The free end of the strip 7 is engaged in a slot 39 in a shaft 40 mounted to rotate in a bore 41 of the body 1, said shaft 40 being subject to the braking action of a spring 42 arranged on the rear side of the body 1 and bearing against a knurled knob 43 integral with the shaft 40.

At the end of the operation, this arrangement makes it possible to store the successive worn portions 44 of the strip on the shafts 40, as illustrated in FIG. 12.

Changing the worn portion of abrasive strip and its replacement by a new portion of strip takes place in the following manner:

The operator loosens the screw 32 and releases from the magazine drum 30 a new portion of cloth, by carrying out a desired angular rotation of said drum in counter-clockwise direction. Then the screw 32 is re-tightened and the operator actuates the knurled knobs 43 in order to rotate the shafts 40 and produce the desired tension of each of th abrasive strips 7 on the layer of resilient material 6.

When the magazine drum 30 is empty, the strips are wound progressively on the shafts 40 and thus form rolls 44 of worn strip, such that the operator may remove the rolls 44 by releasing the strips 7 and loosening the screws 37, the wheel being ready to receive a refill of new abrasive strip in the magazine drum.

Figure 16:
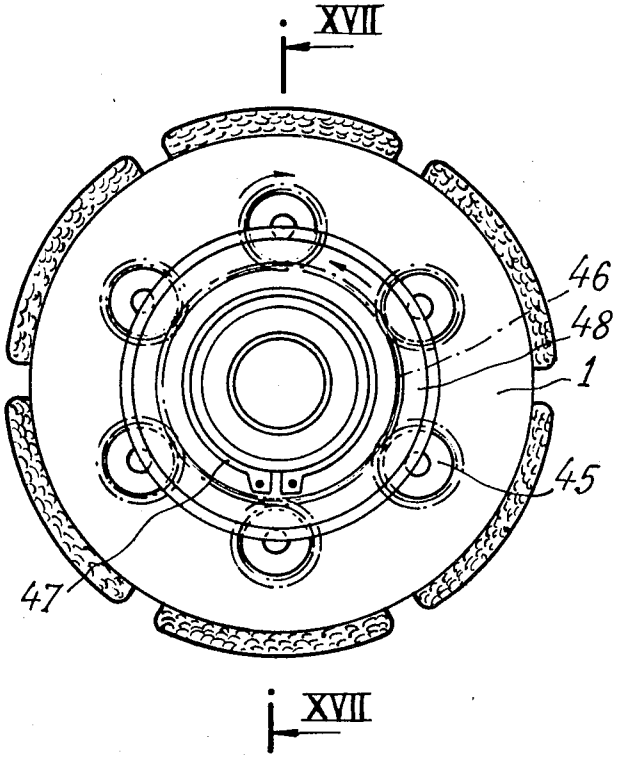
FIG. 16 is a rear end view of a wheel comprising means for the simultaneous control of satellite shafts supporting the abrasive strip.
Figure 17:
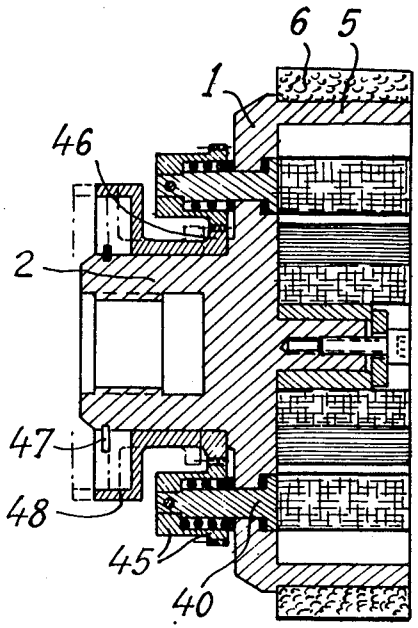
FIG. 17 is a sectional view on line XVII—XVII of FIG. 16.

To achieve more rapid regulation of the arrangement, FIGS. 16 and 17 illustrate means for the simultaneous drive of the shafts 40, which are provided at the rear with satellite pinions 45 which mesh with a toothed wheel 46 mounted to rotate and slide on the hub 2 and able to abut against a split resilient washer 47 engaged in a circular groove in the hub 2.

The toothed ring 46 is extended by an operating knob 48.

When the toothed ring 46 is in the depressed position as shown in broken line in FIG. 17, this facilitates positioning of the beginning of the abrasive strip 7 on each shaft 40 and the first adjustment of tension of the strip.

Then, the toothed ring 46 is moved forwards to occupy the position shown in full line, in which the toothed wheel 46 meshed with the satellite pinions 45 thus making it possible to drive all the shafts 40 simultaneously and proceed to regulating all the abrasive strips.

Figure 15:
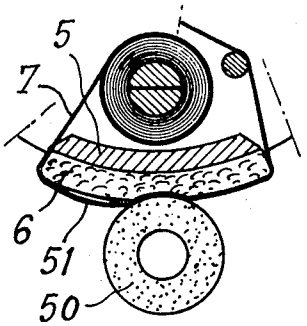
FIG. 15 is a sectional view of a detail of the wheel and pipe during polishing.
Figure 14:
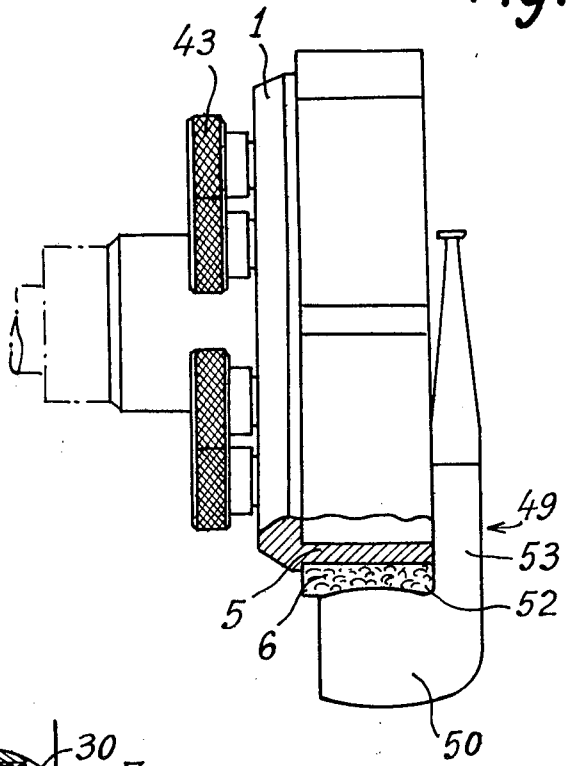
FIG. 14 is a side view of a wheel and pipe during polishing.

FIGS. 14 and 15 show a pipe 49 during polishing, whereof the bowl 50 is in contact at its convex face with the abrasive strip 7, which comprises at the rear, taking into account the direction of rotation of the wheel, a floating part 51 enabling the strip 7 to follow the shape to be polished by deformation of the support 6 and strip.

Furthermore, owing to the particular design of the wheel, whereof an outer edge is free, it is possible to polish the rounded connecting part 52 formed at the point where the stem 53 and the bowl 50 join.

Naturally, various modifications may be applied by a man skilled in the art to the devices or methods which have been described solely as non-limiting examples, without diverging from the framework of the invention.

What we claim is:

1. A polishing wheel comprising a circular rotatable body, a plurality of spaced apart rigid support members provided on the periphery of the rotatable body, a layer of resilient materials provided on the periphery of each said support member and a strip covered with abrasive material supported on each layer of resilient material, the abrasive strip being secured on the support member by means for regulating the tension of said strip, the abrasive strip being an endless abrasive strip which is retained between the downstream end of the support member and a first cylindrical member mounted eccentrically on the body of the polishing wheel, said endless abrasive strip being engaged on a second eccentric cylindrical member and being retained by resilient means.

2. A polishing wheel comprising a circular rotatable body, a plurality of spaced apart rigid support members provided on the periphery of the rotatable body, a layer of resilient material provided on the periphery of each said support member and a strip covered with abrasive material supported on each layer of resilient material, the abrasive strip being secured on the support member by means for regulating the tension of said strip, comprising a plurality of cylindrical members for retaining the ends of the strips between said cylindrical members and the inner side of the support member, each said cylindrical member being mounted eccentrically in a bore in the circular rotatable body and being locked by a screw and in which one end of the strip is secured between an eccentric cylindrical member and the downstream end of the support member, whereas the other end of the strip is fixed on a shaft on which it is wound, said shaft being rotatable in the body and being subject to the tension of a resilient member bearing on one side against the body of the wheel and on the other side against a cap integral with said shaft and comprising a knurled knob.

3. A polishing wheel comprising a circular rotatable body, a plurality of spaced apart rigid support members provided on the periphery of the rotatable body, a layer of resilient material provided on the periphery of each said support member and a strip covered with abrasive material supported on each layer of resilient material, the abrasive strip being secured on the support member by means for regulating the tension of said strip, in which a central magazine is mounted to rotate on the body, the magazine having wound thereon abrasive strips which rest on the respective supports and are wound at the upstream end on shafts located on the periphery of the magazine and mounted to rotate on the body, said shafts being subjected to braking means constituted by a resilient member bearing on the one hand against the body and on the other hand against a knurled knob.

4. A polishing wheel according to claim 3, in which the central magazine is constituted by a drum comprising slots in which are engaged ends of the abrasive strips which are retained by means of screws engaged in tapped holes provided in the drum.

5. A polishing wheel according to claim 3, in which the shafts arranged on the periphery of the magazine are provided with satellite pinions which mesh with a toothed wheel, mounted to rotate and slide on the hub of the wheel.

* * * * *

UNITED STATES PATENT OFFICE

CERTIFICATE OF CORRECTION

Patent No. 4,070,798 Dated JANUARY 31,1978

Inventor(s) JEAN EMAIN

It is certified that error appears in the above-identified patent and that said Letters Patent are hereby corrected as shown below:

COLUMN 1 FOREIGN APPLICATION PRIORITY DATA

[30] AUGUST 26,1975 FRANCE..... 75 26310

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*